US009489938B2

(12) United States Patent
Mizuguchi et al.

(10) Patent No.: US 9,489,938 B2
(45) Date of Patent: Nov. 8, 2016

(54) SOUND SYNTHESIS METHOD AND SOUND SYNTHESIS APPARATUS

(71) Applicant: Yamaha Corporation, Hamamatsu-shi, Shizuoka-ken (JP)

(72) Inventors: Tetsuya Mizuguchi, Tokyo (JP); Kiyohisa Sugii, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 329 days.

(21) Appl. No.: 13/924,387

(22) Filed: Jun. 21, 2013

(65) Prior Publication Data

US 2014/0006031 A1 Jan. 2, 2014

(30) Foreign Application Priority Data

Jun. 27, 2012 (JP) ..... 2012-144811

(51) Int. Cl.

| | |
|---|---|
| ***G10L 13/00*** | (2006.01) |
| ***G10L 13/04*** | (2013.01) |
| ***G10H 7/02*** | (2006.01) |
| ***G10L 13/033*** | (2013.01) |
| *G10H 7/12* | (2006.01) |
| *G10L 13/08* | (2013.01) |

(52) U.S. Cl.

CPC ..... *G10L 13/04* (2013.01); *G10H 7/02* (2013.01); *G10L 13/0335* (2013.01); *G10H 7/12* (2013.01); *G10H 2210/325* (2013.01); *G10H 2220/011* (2013.01); *G10H 2220/126* (2013.01); *G10H 2240/145* (2013.01); *G10H 2250/455* (2013.01); *G10L 13/08* (2013.01)

(58) Field of Classification Search

CPC ..... G10H 7/12; G10H 3/125; G10H 3/22; G10L 13/08

USPC ..... 704/260; 84/645

See application file for complete search history.

(56) References Cited

U.S. PATENT DOCUMENTS

| | | | | |
|---|---|---|---|---|
| 4,731,847 | A * | 3/1988 | Lybrook et al. | 704/260 |
| 6,304,846 | B1 * | 10/2001 | George et al. | 704/270 |
| 6,424,944 | B1 * | 7/2002 | Hikawa | G10L 13/08 704/258 |
| 6,740,802 | B1 * | 5/2004 | Browne, Jr. | 84/609 |
| 7,124,084 | B2 * | 10/2006 | Kayama | G10L 13/06 704/267 |
| 8,682,938 | B2 * | 3/2014 | Kilachand | G10H 1/361 706/12 |
| 2001/0037720 | A1 | 11/2001 | Funaki | |

(Continued)

FOREIGN PATENT DOCUMENTS

| | | |
|---|---|---|
| CN | 1057354 A | 12/1991 |
| CN | 1761992 A | 4/2006 |

(Continued)

OTHER PUBLICATIONS

Yamaha Vocaloid Keyboard—Play Hatsune Miku Songs Live! (published on Mar. 20, 2012) <http://www.youtube.com/watch?v=d9e87KLMrng, 3.20 minutes.

(Continued)

*Primary Examiner* — Daniel Abebe

(74) *Attorney, Agent, or Firm* — Morrison & Foerster LLP

(57) ABSTRACT

A sound synthesis apparatus connected to a display device, includes a processor configured to: display a lyric on a screen of the display device; input a pitch based on an operation of a user, after the lyric has been displayed on the screen; and output a piece of waveform data representing a singing sound of the displayed lyric based on the inputted pitch.

13 Claims, 7 Drawing Sheets

(56) References Cited

U.S. PATENT DOCUMENTS

| | | | | |
|---|---|---|---|---|
| 2006/0156909 | A1 | 7/2006 | Kobayashi | |
| 2009/0217805 | A1* | 9/2009 | Lee | G10H 7/006 84/611 |
| 2009/0306987 | A1* | 12/2009 | Nakano et al. | 704/260 |
| 2011/0219940 | A1* | 9/2011 | Jiang | G10H 1/0025 84/622 |
| 2011/0231193 | A1* | 9/2011 | Qian et al. | 704/260 |
| 2011/0246186 | A1* | 10/2011 | Takeda | G10H 1/0008 704/201 |
| 2013/0218929 | A1* | 8/2013 | Kilachand | G10H 1/361 707/803 |
| 2014/0046667 | A1* | 2/2014 | Yeom et al. | 704/258 |

FOREIGN PATENT DOCUMENTS

| | | | |
|---|---|---|---|
| CN | 101313477 | A | 11/2008 |
| JP | 2001-159892 | A | 6/2001 |
| JP | 2002-278549 | A | 9/2002 |
| JP | 2004-258561 | A | 9/2004 |
| JP | 2006-258846 | A | 9/2006 |
| JP | 2007-219139 | A | 8/2007 |
| JP | 2007-240564 | A | 9/2007 |
| JP | 2008-020798 | A | 1/2008 |
| JP | 2008-170592 | A | 7/2008 |
| JP | 2010-169889 | A | 8/2010 |
| JP | 2012-083563 | A | 4/2012 |
| JP | 2012-083569 | A | 4/2012 |
| JP | 2012-083570 | A | 4/2012 |

OTHER PUBLICATIONS

Notification of Reasons for Refusal mailed Sep. 9, 2014, for JP Patent Application No. 2012-144811, with English translation, 11 pages.

Notification of Reasons for Refusal dated Apr. 22, 2015, for JP Patent Application No. 2012-144811, with English translation, eight pages.

Chinese Search Report dated Aug. 20, 2015, for CN Patent Application No. 201310261608.5, with English translation, 4 pages.

Notification of the first Office Action dated Aug. 20, 2015, for CN Patent Application No. 201310261608.5, with English translation, 14 pages.

European Search Report dated Jun. 6, 2016, for EP Application No. 13173501.1, seven pages.

* cited by examiner

SOUND SYNTHESIS METHOD AND SOUND SYNTHESIS APPARATUS

BACKGROUND

This invention relates to a sound synthesis technology, and particularly, relates to a sound synthesis apparatus and a sound synthesis method suitable for sound synthesis performed in real time.

In recent years, vocal performances have come to be performed by using a sound synthesis apparatus (singing voice synthesis apparatus) at live performances, and a sound synthesis apparatus capable of real-time sound synthesis is demanded. To fulfill such a demand, JP-A-2008-170592 proposes a sound synthesis apparatus having a structure in which lyric data is successively read from a memory while melody data generated by the user through a keyboard operation or the like is received, and sound synthesis is performed. Moreover, JP-A-2012-83569 proposes a sound synthesis apparatus in which melody data is stored in a memory and a singing sound along the melody represented by the melody data is synthesized according to an operation to designate phonograms constituting the lyric.

With the above-described conventional sound synthesis apparatus, at the time of singing synthesis, either the lyric or the melody is necessarily stored in a memory previously and it is therefore difficult to perform sound synthesis while changing both the lyric and the melody extemporaneously. Accordingly, a sound synthesis apparatus has recently been proposed that performs real-time synthesis of a synthetic singing voice corresponding to the designated phonograms and having the designated pitch by designating the vowel and a consonant of the phonogram constituting the lyric by a key manipulation with the left hand while designating pitch by a keyboard operation with the right hand. With this sound synthesis apparatus, since the input of the lyric with the left hand and the designation of the pitch with the right hand can be independently performed in parallel, it is possible that an arbitrary lyric is sung to an arbitrary melody. However, since it is a busy manipulation to input the vowels and consonants of the lyric one by one by the manipulation with the left hand while playing the melody with the right hand, without considerable proficiency, it is difficult to perform a vocal performance rich in extemporaneousness.

SUMMARY

This invention is made in view of the above-mentioned circumstances, and an object thereof is to provide a sound synthesis apparatus with which a real-time vocal performance rich in extemporaneousness can be performed by an easy operation.

This invention provides a sound synthesis method using an apparatus connected to a display device, the sound synthesis method comprising:

a first step of displaying a lyric on a screen of the display device;

a second step of inputting a pitch based on an operation of a user, after the first step is completed; and a third step of outputting a piece of waveform data representing a singing sound of the displayed lyric based on the inputted pitch.

For example, the sound synthesis method further comprising:

a fourth step of storing a piece of phrase data representing a sound corresponding to the lyric displayed on the screen into a storage in the apparatus, and the piece of phrase data being constituted by a plurality of pieces of syllable data, wherein in the third step, pitch conversion based on the inputted pitch is performed on each of the plurality of pieces of syllable data which constitutes the piece of phrase data to generate and output the piece of waveform data representing the singing sound with the pitch.

For example, every time the pitch is inputted in the second step, a sequence of syllable data is read among the plurality of pieces of syllable data stored in the storage and the pitch conversion based on the inputted pitch is performed on the sequence of syllable data.

For example, the lyric displayed on the screen in the first step is constituted by a plurality of syllables, the sound synthesis further comprises: a fifth step of selecting a syllable among the lyric displayed on the screen, and when the pitch based on the operation of the user is inputted in the second step after the first step and the fifth step are completed, a piece of syllable data corresponding to the syllable selected in the fifth step is read from the storage and the pitch conversion based on the inputted pitch is performed on the read piece of the syllable data.

For example, the lyric, selected among a plurality of lyrics which are displayed on the screen, is displayed on the screen in the first step.

For example, the plurality of lyrics are displayed on the screen based on relevance.

For example, the plurality of lyrics are displayed on the screen based on a result of a keyword search.

For example, the lyric displayed on the screen in the first step is constituted by a plurality of syllables, and syllable separations which separate the plurality of syllables respectively are visually displayed on the screen.

For example, the plurality of lyrics are hierarchized in a hierarchical structure having hierarchies, and the lyric, which is selected by designating at least one hierarchy among the hierarchies, is displayed on the screen in the first step.

According to the present invention, there is also provided a sound synthesis apparatus connected to a display device, the sound synthesis apparatus comprising:

a processor configured to:

display a lyric on a screen of the display device;

input a pitch based on an operation of a user, after the lyric has been displayed on the screen; and output a piece of waveform data representing a singing sound of the displayed lyric based on the inputted pitch.

For example, the sound synthesis apparatus further comprises: a storage, and the processor stores a piece of phrase data representing a sound corresponding to the lyric displayed on the screen into the storage, the piece of phrase data is constituted by a plurality of pieces of syllable data, and the processor performs pitch conversion based on the inputted pitch on each of the plurality of pieces of syllable data which constitutes the piece of phrase data to generate and output the piece of waveform data representing the singing sound with the pitch.

For example, every time the processor inputs the pitch, a sequence of syllable data is read among the plurality of pieces of syllable data stored in the storage and the pitch conversion based on the inputted pitch is performed on the sequence of syllable data.

For example, the lyric displayed on the screen is constituted by a plurality of syllables, and when processor inputs the pitch based on the operation of the user after the lyric is displayed on the screen and a syllable is selected among the lyric displayed on the screen, the processor reads a piece of syllable data corresponding to the selected syllable from the storage and performs the pitch conversion based on the inputted pitch on the read piece of the syllable data.

For example, the operation of the user is conducted through a keyboard or a touch panel provided on the screen of the display device.

According to this invention, it can be performed to select a desired lyric among a plurality of lyrics displayed on the screen by the operation of an operation portion, select an arbitrary section of the selected lyric by the operation of the operation portion and output the selected section of the lyric as a singing sound of a desired pitch by the operation of the operation portion. Consequently, a real-time vocal performance rich in extemporaneousness can be performed.

DETAILED DESCRIPTION OF EXEMPLARY EMBODIMENTS

Figure 1:
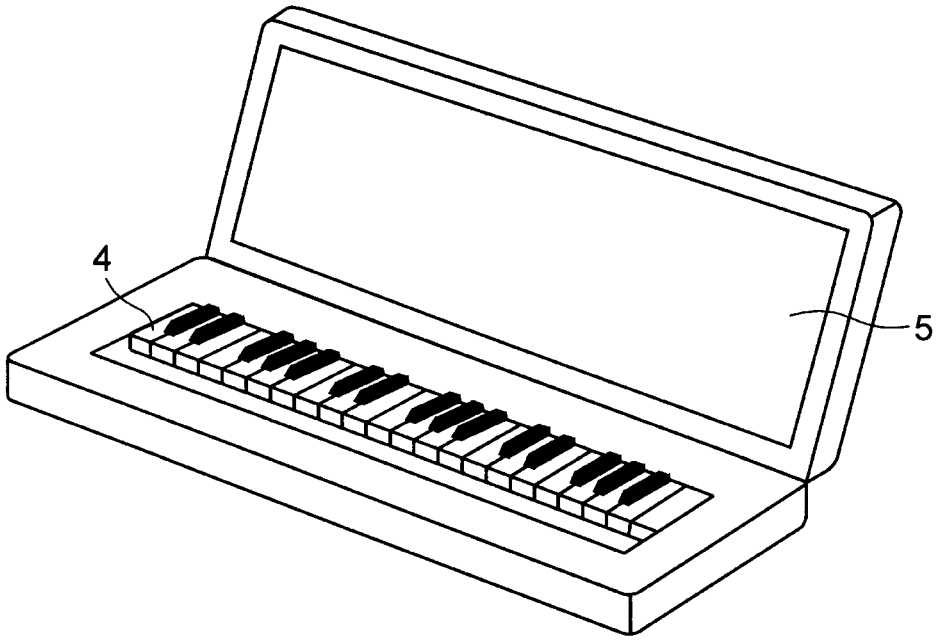
FIG. 1 is a perspective view showing the appearance of a sound synthesis apparatus according to an embodiment of this invention.

Hereinafter, referring to the drawings, an embodiment of this invention will be described.

Figure 2:
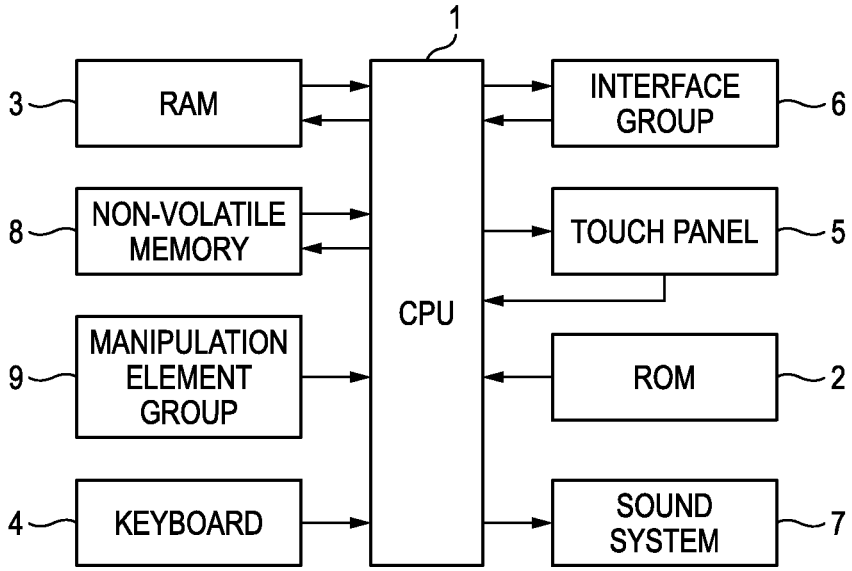
FIG. 2 is a block diagram showing the electric structure of the sound synthesis apparatus.

FIG. 1 is a perspective view showing the appearance of a sound synthesis apparatus according to the embodiment of this invention. FIG. 2 is a block diagram showing the electric structure of the sound synthesis apparatus according to the present embodiment. In FIG. 2, a CPU 1 is a control center that controls components of this sound synthesis apparatus. A ROM (Read-Only Memory) 2 is a read only memory storing a control program to control basic operations of this sound synthesis apparatus such as a loader. A RAM (Random Access Memory) 3 is a volatile memory used as the work area by the CPU 1. A keyboard 4 is a keyboard similar to that provided in normal keyboard instruments, and used as musical note input device in the present embodiment. A touch panel 5 is a user interface having a display function of displaying the operation condition of the sound synthesis apparatus, input data and messages to the operator (user) and an input function of accepting manipulations performed by the user. The contents of the manipulations performed by the user include the input of information representative of lyrics, the input of information representative of musical notes and the input of an instruction to play back a synthetic singing sound (synthetic singing voice). The sound synthesis apparatus according to the present embodiment has a foldable housing as shown in FIG. 1, and the keyboard 4 and the touch panel 5 are provided on the two surfaces inside this housing. Instead of the keyboard 4, a keyboard image may be displayed on the touch panel 5. In this case, the operator can input or select the musical note (pitch) by using the keyboard image.

In FIG. 2, an interface group 6 includes: an interface for performing data communication with another apparatus such as a personal computer; and a driver for performing data transmission and reception with an external storage medium such as a flash memory.

A sound system 7 outputs, as a sound, time-series digital data representative of the waveform of the synthetic singing sound (synthetic singing voice) obtained by this sound synthesis apparatus, and includes: a D/A converter that converts the time-series digital data representative of the waveform of the synthetic singing sound into an analog sound signal; an amplifier that amplifies this analog sound signal; and a speaker that outputs the output signal of the amplifier as a sound. A manipulation element group 9 includes manipulation elements other than the keyboard 4 such as a pitchbend wheel and a volume knob.

A non-volatile memory 8 is a storage device for storing information such as various programs and databases, and for example, an EEPROM (electrically erasable programmable read only memory) is used thereas. Of the storage contents of the non-volatile memory 8, one specific to the present embodiment is a singing synthesis program. The CPU 1 loads a program in the non-volatile memory 8 into the RAM 3 for execution according to an instruction inputted through the touch panel 5 or the like.

The programs and the like stored in the non-volatile memory 8 may be traded by a download through a network. In this case, the programs and the like are downloaded through an appropriate one of the interface group 6 from a site on the Internet, and installed into the non-volatile memory 8. Moreover, the programs may be traded under a condition of being stored in a computer-readable storage medium. In this case, the programs and the like are installed into the non-volatile memory 8 through an external storage medium such as a flash memory.

Figure 3:
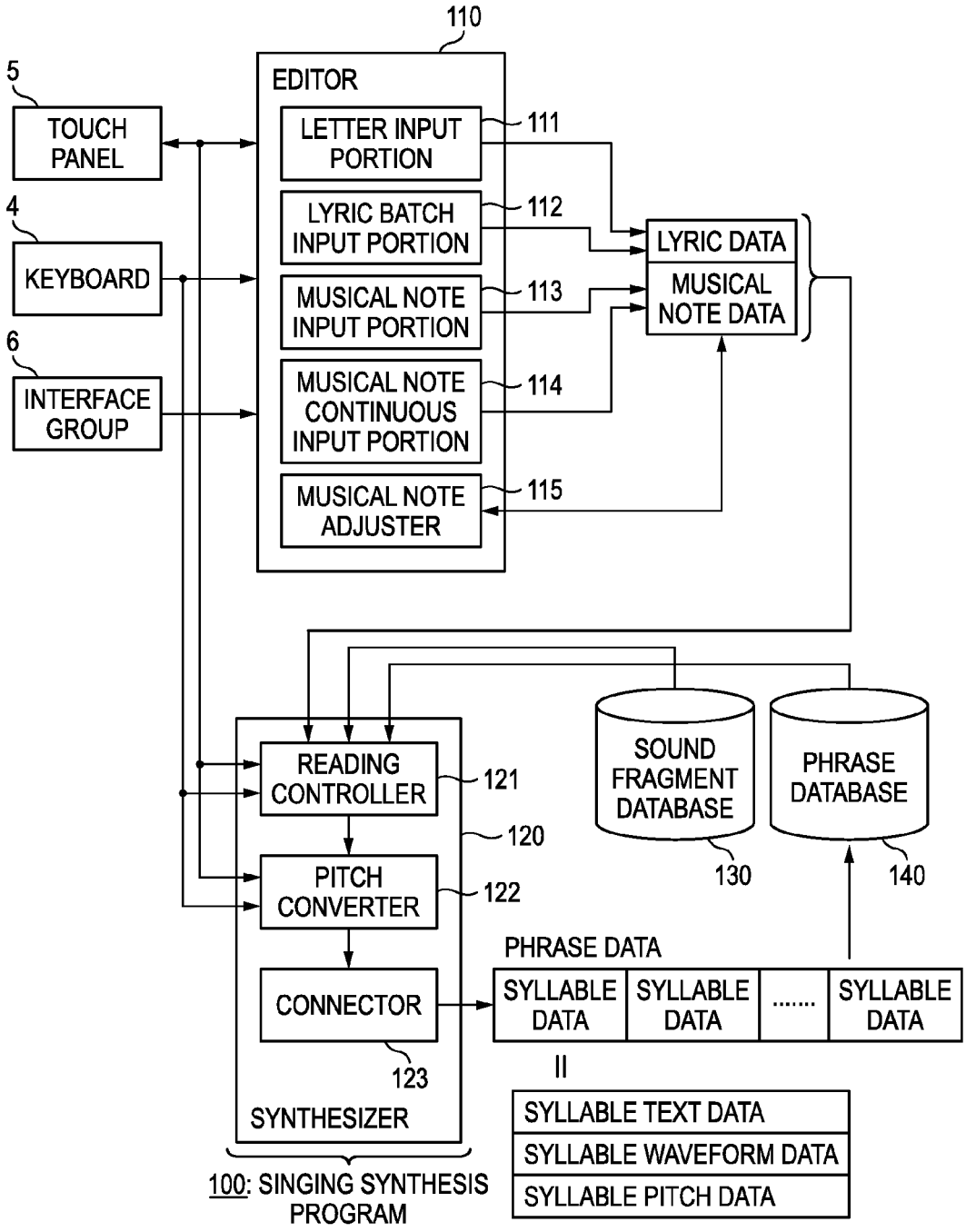
FIG. 3 is a block diagram showing the structure of a sound synthesis program installed on the sound synthesis apparatus.

FIG. 3 is a block diagram showing the structure of a singing synthesis program 100 installed in the non-volatile memory 8. In FIG. 3, to facilitate the understanding of the functions of the singing synthesis program 100, the touch panel 5, the keyboard 4, the interface group 6, and a sound fragment database 130 and a phrase database 140 that are stored in the non-volatile memory 8 are illustrated together with the components of the singing synthesis program 100.

The operation modes of the sound synthesis apparatus according to the present embodiment can be broadly divided into an edit mode and a playback mode. The edit mode is an operation mode of generating a pair of lyric data and musical note data according to the information supplied through the keyboard 4, the touch panel 5 or an appropriate interface of the interface group 6. The musical note data is time-series data representative of the pitch, the pronunciation timing and the musical note length for each of the musical notes constituting the song. The lyric data is time-series data representative of the lyric sung according to the musical notes represented by the musical note data. The lyric may be a poem or a line (muttering), a tweet of Twitter (trademark) and the like, or a general sentence (may be one like a lyric of rap music) as well as a lyric of a song. The playback mode is an operation mode of generating phrase data from the pair of lyric data and musical note data or generating another phrase data from phrase data generated in advance according to an operation/manipulation of the operation portion such as the touch panel 5, and outputting it from the sound system 7 as a synthetic singing sound (synthetic singing voice). The phrase data is time-series data on which the synthetic singing sound is based, and includes time-series sample data of the singing sound waveform. The singing synthesis program 100 according to the present embodiment has an editor 110 for implementing operations in the edit mode and a synthesizer 120 for implementing operations in the playback mode.

The editor 110 has a letter input portion 111, a lyric batch input portion 112, a musical note input portion 113, a musical note continuous input portion 114 and a musical note adjuster 115. The letter input portion 111 is a software module that receives letter information (textual information) inputted by designating a software key displayed on the touch panel 5 and uses it for lyric data generation. The lyric batch input portion 112 is a software module that receives text data supplied from a personal computer through one interface of the interface group 6 and uses it for lyric data generation. The musical note input portion 113 is a software module that receives musical note information inputted by the user's specification of a desired position of a musical note display section and uses it for musical note data generation under a condition where a piano role formed of images of a piano keyboard and a musical note display section is displayed on the touch panel 5. The musical note input portion 113 may receive musical note information from the keyboard 4. The musical note continuous input portion 114 is a software module that successively receives key depression events generated by the user's keyboard performance using the keyboard 4 and generates musical note data by using the received key depression events. The musical note adjuster 115 is a software module that adjusts the pitch, musical note length and pronunciation timing of the musical notes represented by the musical note data according to a manipulation of the touch panel 5 or the like.

The editor 110 generates a pair of lyric data and musical note data by using the letter input portion 111, the lyric batch input portion 112, the musical note input portion 113 or the musical note continuous input portion 114. In the present embodiment, several kinds of edit modes for generating the pair of lyric data and musical note data are prepared.

Figure 4:
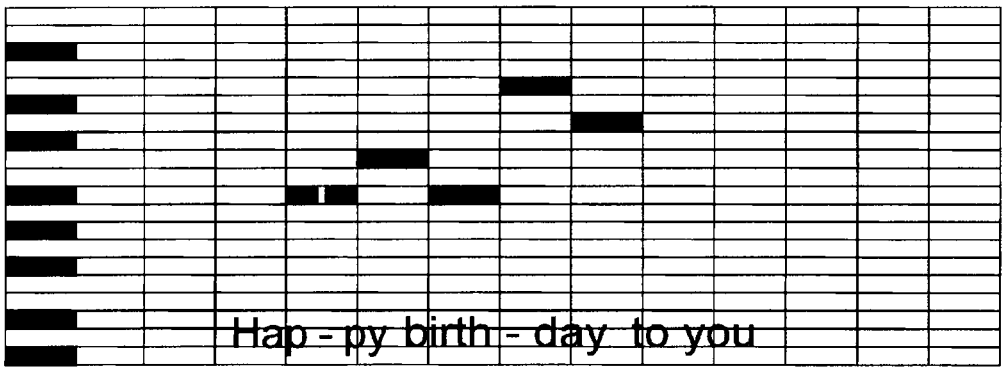
FIG. 4 is a view showing a display screen in an edit mode of the embodiment.

In a first edit mode, the editor 110 displays on the touch panel 5 a piano role formed of images of a piano keyboard and a musical note display section on the right side thereof as illustrated in FIG. 4. Under this condition, when the user designates a desired position in the musical note display section to thereby input a musical note, as illustrated in FIG. 4, the musical note input portion 113 displays a rectangle (black rectangle in FIG. 4) indicating the inputted musical note on the staff, and maps the information corresponding to the musical note in a musical note data storage area which is set in the RAM 3. Moreover, when the user designates a desired musical note displayed on the touch panel 5 and inputs a lyric by manipulating software keys (not-illustrated), the letter input portion 111 displays the inputted lyric in the musical note display section as illustrated in FIG. 4, and maps the information corresponding to the lyric in a lyric data storage area which is set in the RAM 3.

In a second edit mode, the user performs a keyboard performance. The musical note continuous input portion 114 of the editor 110 successively receives the key depression events generated by playing the keyboard, and maps the information related to the musical notes represented by the received key depression events, in the musical note data storage area which is set in the RAM. Moreover, the user causes the text data representative of the lyric of the song played in the keyboard to be supplied to one interface of the interface group 6, for example, from a personal computer. When the personal computer has a sound input portion such as a microphone and sound recognition software, it is possible for the personal computer to convert the lyric uttered by the user into text data by the sound recognition software and supply this text data to the interface of the sound synthesis apparatus. The lyric batch input portion 112 of the editor 110 divides the text data supplied from the personal computer into syllables, and maps them in the musical note storage area which is set in the RAM 3 so that the text data corresponding to each syllable is uttered at the timing of each musical note represented by the musical note data.

In a third edit mode, the user hums a song instead of performing a keyboard performance. A non-illustrated personal computer picks up this humming with a microphone, obtains the pitch of the humming sound, generates musical note data, and supplies it to one interface of the interface group 6. The musical note continuous input portion 114 of the editor 110 writes this musical note data supplied from the personal computer, into the musical note storage area of the RAM 3. The input of the lyric data is performed by the lyric batch input portion 112 similarly to the above. This edit mode is advantageous in that musical note data can be easily inputted.

The above is the details of the function of the editor 110.

As shown in FIG. 3, the synthesizer 120 has a reading controller 121, a pitch converter 122 and a connector 123 as portions for implementing operations in the playback mode.

In the present embodiment, the playback mode implemented by the synthesizer 120 may be divided into an automatic playback mode and a real-time playback mode.

Figure 5:
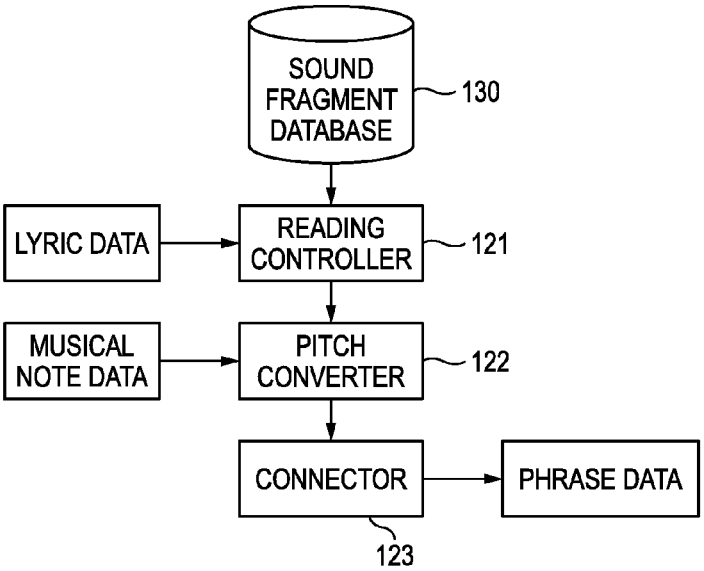
FIG. 5 is a block diagram showing the condition of a synthesizer of the sound synthesis program in an automatic playback mode.

FIG. 5 is a block diagram showing the condition of the synthesizer 120 in the automatic playback mode. In the automatic playback mode, as shown in FIG. 5, phrase data is generated from the pair of lyric data and musical note data generated by the editor 110 and stored in the RAM 3 and the sound fragment database 130.

The sound fragment database 130 is an aggregate of pieces of sound fragment data representative of various sound fragments serving as materials for a singing sound (singing voice) such as a part of transition from silence to a consonant, a part of transition from a consonant to a vowel, a drawled sound of a vowel and a part of transition from a vowel to silence. These pieces of sound fragment data are data created based on the sound fragments extracted from the sound waveform uttered by an actual person.

In the automatic playback mode, when a playback instruction is provided by the user by using, for example, the touch panel 5, as shown in FIG. 5, the reading controller 121 scans each of the lyric data and the musical note data in the RAM 3 from the beginning. Then, the reading controller 121 reads the musical note information (pitch, etc.) of one musical note from the musical note data and reads the information representative of a syllable to be pronounced according to the musical note from the lyric data, then, resolves the syllable to be pronounced into sound fragments, reads the sound fragment data corresponding to the sound fragments from the sound fragment database 130, and supplies it to the pitch converter 122 together with the pitch read from the musical note data. The pitch converter 122 performs pitch conversion on the sound fragment data read from the sound fragment database 130 by the reading controller 121, thereby generating sound fragment data having the pitch represented by the musical note data read by the reading controller 121. Then, the connector 123 connects on the time axis the pieces of pitch-converted sound fragment data thus obtained for each syllable, thereby generating phrase data.

In the automatic playback mode, when phrase data is generated from the pair of lyric data and musical note data as described above, this phrase data is sent to the sound system 7 and outputted as a singing sound.

In the present embodiment, the phrase data generated from the pair of lyric data and musical note data as described above may be stored in the phrase database 140. As illustrated in FIG. 3, the pieces of phrase data constitutes the phrase database 140, and the pieces of phrase data are each constituted by a plurality of pieces of syllable data each corresponding to one syllable. The pieces of syllable data are each constituted by syllable text data, syllable waveform data and syllable pitch data. The syllable text data is text data obtained by sectioning, for each syllable, the lyric data on which the phrase data is based, and represents the letter corresponding to the syllable. The syllable waveform data is sample data of the sound waveform representative of the syllable. The syllable pitch data is data representative of the pitch of the sound waveform representative of the syllable (that is, the pitch of the musical note corresponding to the syllable). The unit of the phrase data is not limited to syllable but may be word or clause or may be an arbitrary one selected by the user.

The real-time playback mode is an operation mode in which as shown in FIG. 3, phrase data is selected from the phrase database 140 according to a manipulation of the touch panel 5 and another phrase data is generated from the selected phrase data according to an operation of the operation portion such as the touch panel 5 or the keyboard 4.

In this real-time playback mode, the reading controller 121 extracts the syllable text data from each piece of phrase data in the phrase database 140, and displays each extracted peace of the syllable text data in menu form on the touch panel 5 as the lyric represented by each piece of phrase data. Under this condition, the user can designate a desired lyric among the lyrics displayed in menu form on the touch panel 5. The reading controller 121 reads from the phrase database 140 the phrase data corresponding to the lyric designated by the user, as the object to be played back, stores it in a playback object area in the RAM 3, and displays it on the touch panel 5.

Figure 6:
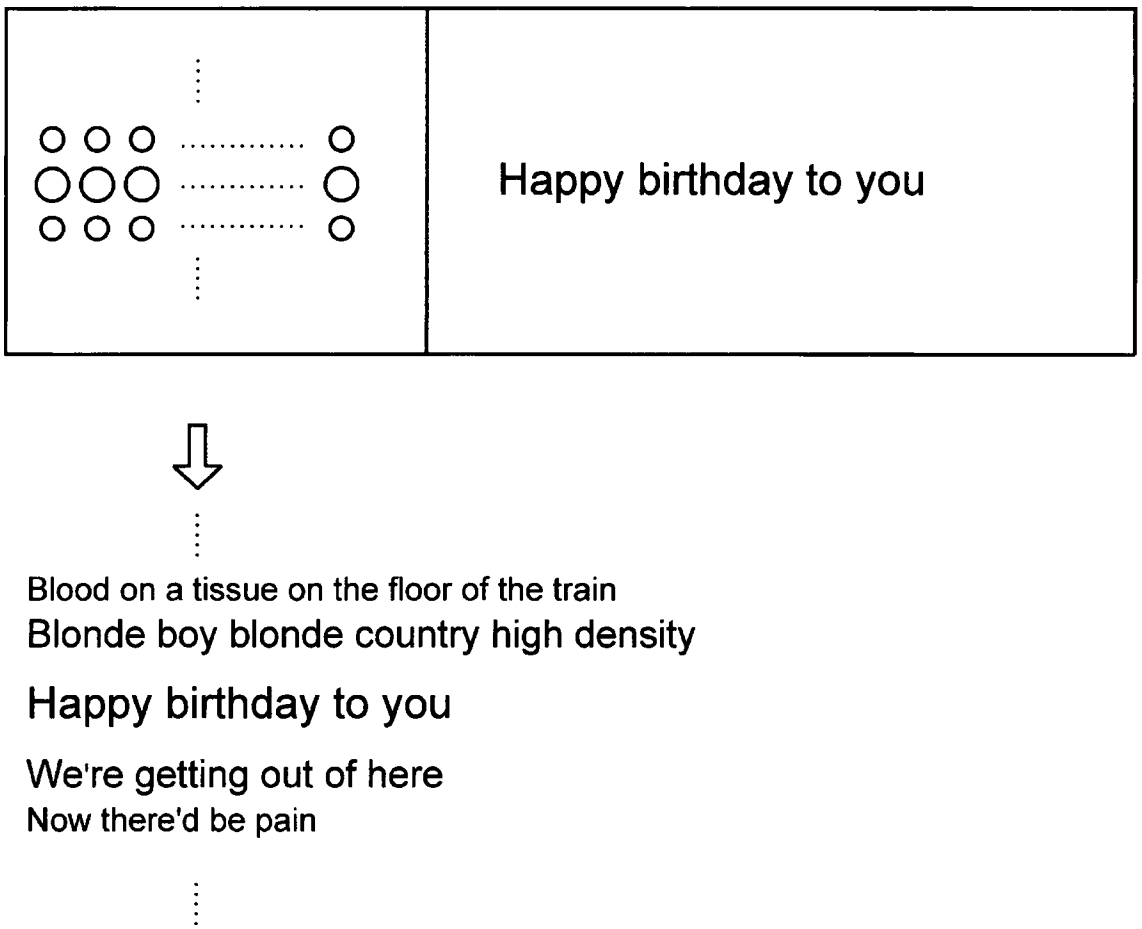
FIG. 6 is a view showing a display screen of the sound synthesis apparatus in a real-time playback mode.

FIG. 6 shows a display example of the touch panel 5 in this case. As shown in FIG. 6, the area on the left side of the touch panel 5 is a menu display area where a menu of lyrics is displayed, and the area on the right side is a direction area where the lyric selected by the user's touching with a finger is displayed. In the illustrated example, the lyric "Happy birthday to you" selected by the user is displayed in the direction area, and the phrase data corresponding to this lyric is stored in the playback object area of the ROM 3. The menu of lyrics in the menu display area can be scrolled in the vertical direction by moving a finger upward or downward while touching it with the finger. In this example, to facilitate the designating operation, the lyrics situated closer to the center are displayed in larger letters, and the lyrics are displayed in smaller letters as they become farther away in the vertical direction.

Under this condition, by a manipulation of the operation portion such as the keyboard 4 or the touch panel 5, the user can select an arbitrary section (specifically, syllable) of the phrase data stored in the playback object data, as the object to be played back and designate the pitch when the object to be played back is played back as a synthetic singing sound. The method of selecting the section to be played back and the method of designating the pitch will be made clear in the description of the operation of the present embodiment to avoid duplication of description.

The reading controller 121 selects the data of the section thus designated by the user (specifically, the syllable data of the designated syllable) from the phrase data stored in the playback object area of the RAM 3, reads it, and supplies it to the pitch converter 122. The pitch converter 122 extracts the syllable waveform data and the syllable pitch data from the syllable data supplied from the reading controller 121, and obtains a pitch ratio P1/P2 which is the ratio between a pitch P1 designated by the user and a pitch P2 represented by the syllable pitch data. Then, the pitch converter 122 performs pitch conversion on the syllable waveform data, for example, by a method in which time warping or pitch/tempo conversion is performed on the syllable waveform data at a ratio corresponding to the pitch ratio P1/P2, generates syllable waveform data having the pitch P1 designated by the user, and replaces the original syllable waveform data with it. The connector 123 successively receives the pieces of syllable data having undergone the processing by the pitch converter 122, smoothly connects on the time axis the pieces of syllable waveform data in the pieces of syllable data lining one behind another, and outputs it.

The above is the details of the functions of the synthesizer 120.

Next, the operation of the present embodiment will be described. In the present embodiment, the user can set the operation mode of the sound synthesis apparatus to the edit mode or to the playback mode by a manipulation of, for example, the touch panel 5. The edit mode is, as mentioned previously, an operation mode in which the editor 110 generates a pair of lyric data and musical note data according to an instruction from the user. On the other hand, the playback mode is an operation mode in which the above-described synthesizer 120 generates the phrase data according to an instruction from the user and outputs this phrase data from the sound system 7 as a synthetic singing sound (synthetic singing voice).

As mentioned previously, the playback mode includes the automatic playback mode and the real-time playback mode. The real-time playback mode includes three modes of a first mode to a third mode. In which operation mode the sound synthesis apparatus is operated can be designated by a manipulation of the touch panel 5.

When the automatic playback mode is set, the synthesizer 120 generates phrase data from a pair of lyric data and musical note data in the RAM 3 as described above.

When the real-time playback mode is set, the synthesizer 120 generates another phrase data from the phrase data in the playback object area of the RAM 3 as described above, and causes it to be outputted from the sound system 7 as a synthetic singing sound. Details of the operation to generate another phrase data from this phrase data are different among the first to third modes.

Figure 7:
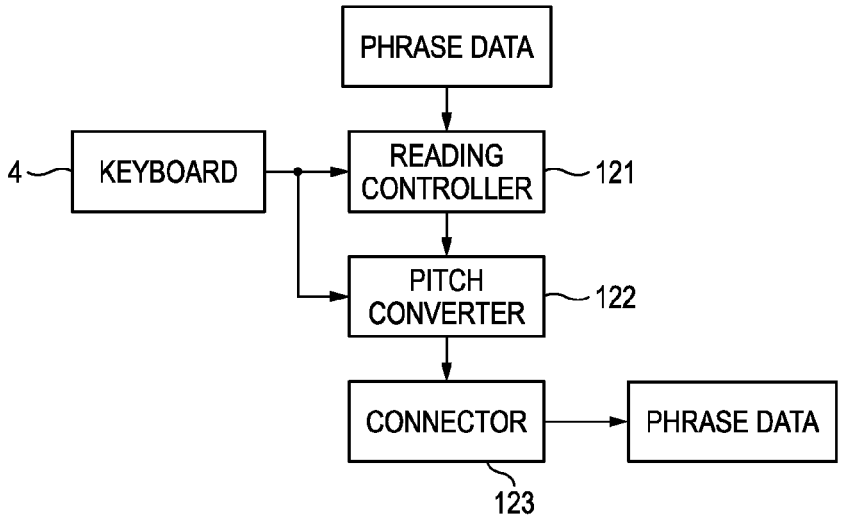
FIG. 7 is a block diagram showing the condition of the synthesizer in a first mode of the real-time playback mode.

FIG. 7 shows the condition of the synthesizer 120 in the first mode. In the first mode, both the reading controller 121 and the pitch converter 122 operate based on the key depression events from the keyboard 4. When the first key depression event is generated at the keyboard 4, the reading controller 121 reads the first syllable data of the phrase data in the playback object area, and supplies it to the pitch converter 122. The pitch converter 122 performs pitch conversion on the syllable waveform data in the first syllable data, generates syllable waveform data having the pitch represented by the first key depression event (pitch of the depressed key), and replaces the original syllable waveform data with the syllable waveform data having the pitch represented by the first key depression event. This pitch-converted syllable data is supplied to the connector 123. Then, when the second key depression event is generated at the keyboard 4, the reading controller 121 reads the second syllable data of the phrase data in the playback object area, and supplies it to the pitch converter 122. The pitch converter 122 performs pitch conversion on the syllable waveform data of the second syllable data, generates syllable waveform data having the pitch represented by the second key depression event, and replaces the original syllable waveform data with the syllable waveform data having the pitch represented by the second key depression event. Then, this pitch-converted syllable data is supplied to the connector 123. The subsequent operations are similar: Every time a key depression event is generated, the succeeding syllable data is successively read, and pitch conversion based on the key depression event is performed.

Figure 8:
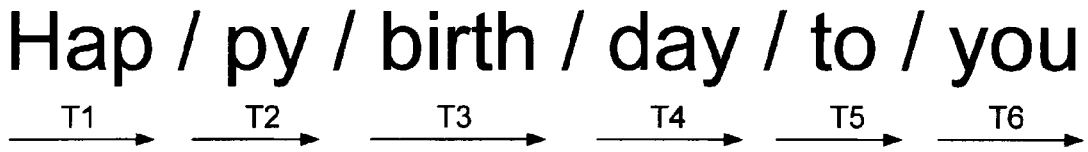
FIG. 8 is a view showing a manipulation example of the synthesizer in the first mode of the real-time playback mode.

FIG. 8 shows an operation example of this first mode. In this example, a lyric "Happy birthday to you" is displayed on the touch panel 5, and the phrase data of this lyric is stored in the playback object area. The user depresses the keyboard 4 six times. During the period T1 in which the first key depression is performed, the syllable data of the first syllable "Hap" is read from the playback object area, undergoes pitch conversion based on the key depression event, and is outputted in the form of a synthetic singing sound (synthetic singing voice). During the period T2 in which the second key depression is performed, the syllable data of the second syllable "py" is read from the playback object area, undergoes pitch conversion based on the key depression event, and is outputted in the form of a synthetic singing sound. The subsequent operations are similar: During the periods T3 to T6 in each of which a key depression is generated, the syllable data of the succeeding syllables is successively read, undergoes pitch conversion based on the key depression event, and is outputted in the form of a synthetic singing sound.

Although not shown in the figures, the user may select another lyric before a synthetic singing sound is generated for all the syllables of the lyric displayed on the touch panel 5 and generate a synthetic singing sound for each sound of the lyric. For example, in the example shown in FIG. 8, the user may designate, after a synthetic singing sound of up to the syllable "day" is generated by depressing the keyboard 4, for example, another lyric "We're getting out of here" shown in FIG. 6. Thereby, the reading controller 121 reads from the phrase database 140 the phrase data corresponding to the lyric selected by the user, stores it in the playback object area in the RAM 3, and displays the lyric "We're getting out of here" on the touch panel 5 based on the syllable text data of this phrase data. Under this condition, by depressing one or more keys of the keyboard 4, the user can generate synthetic singing sounds of the syllables of the new lyric.

As described above, in the first mode, the user can select a desired lyric by a manipulation of the touch panel 5, convert each syllable of the lyric into a synthetic singing sound with a desired pitch at a desired timing by a depression operation of the keyboard 4 and cause it to be outputted. Moreover, in the first mode, since the selection of a syllable and singing synthesis thereof are performed in synchronism with a key depression, the user can also perform singing synthesis with a tempo change, for example, by arbitrarily setting the tempo and performing a keyboard performance in the set tempo.

Figure 9:
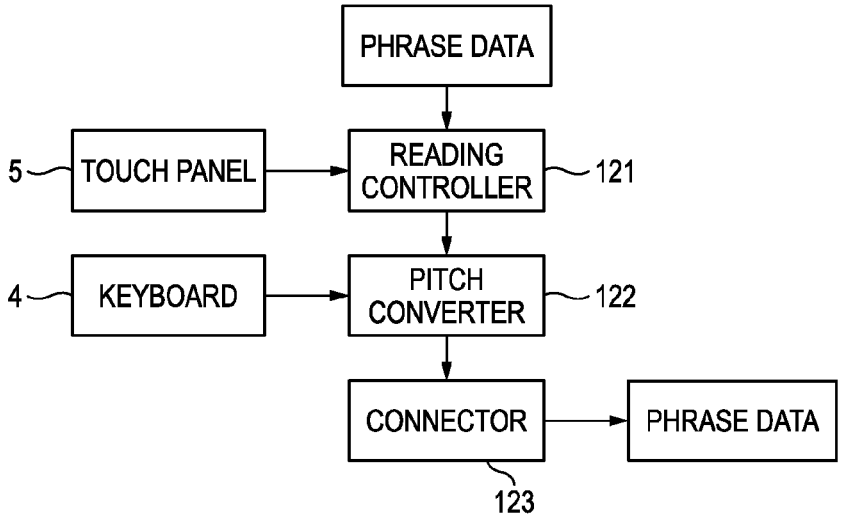
FIG. 9 is a block diagram showing the condition of the synthesizer in a second mode of the real-time playback mode.

FIG. 9 shows the condition of the synthesizer 120 in the second mode. In the second mode, the reading controller 121 operates based on a manipulation of the touch panel 5, and the pitch converter 122 operates based on a key depression event from the keyboard 4. Further describing in detail, the reading controller 121 determines the syllable designated by the user from among the syllables constituting the lyric displayed on the touch panel 5, reads the syllable data of the designated syllable of the phrase data in the playback object area, and supplies it to the pitch converter 122. When a key depression event is generated from the keyboard 4, the pitch converter 122 performs pitch conversion on the syllable waveform data of the syllable data supplied immediately therebefore, generates syllable waveform data having the pitch represented by the key depression event (pitch of the depressed key), replaces the original syllable waveform data with it, and supplies it to the connector 123. In addition, when two points on the lyric are specified with fingers of the operator in the second mode, a synthetic singing sound formed by repeating a section between the two points on the lyric may be outputted.

Figure 10:
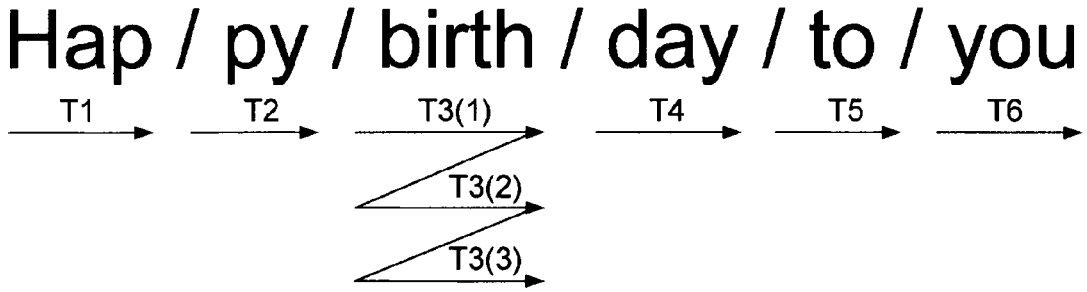
FIG. 10 is a view showing a manipulation example of the synthesizer in the second mode of the real-time playback mode.

FIG. 10 shows an operation example of this second mode. In this example, the lyric "Happy birthday to you" is also displayed on the touch panel 5, and the phrase data of this lyric is stored in the playback object area. The user designates the syllable "Hap" displayed on the touch panel 5, and depresses a key of the keyboard 4 in the succeeding period T1. Consequently, the syllable data of the syllable "Hap" is read from the playback object area, undergoes pitch conversion based on the key depression event, and is outputted in the form of a synthetic singing sound. Then, the user designates the syllable "py" displayed on the touch panel 5, and depresses a key of the keyboard 4 in the succeeding period T2. Consequently, the syllable data of the syllable "py" is read from the playback object area, undergoes pitch conversion based on the key depression event, and is outputted in the form of a synthetic singing sound (synthetic singing voice). Then, the user designates the syllable "birth", and depresses a key of the keyboard 4 three times in the succeeding periods T3(1) to T3(3). Consequently, the syllable data of the syllable "birth" is read from the playback object area, in each of the periods T3(1) to T3(3), pitch conversion based on the key depression event generated at that point of time is performed on the syllable waveform data of the syllable "birth", and the data is outputted in the form of a synthetic singing sound. Similar operations are performed in the succeeding periods T4 to T6.

As described above, in the second mode, the user can select a desired lyric by a manipulation of the touch panel 5, select a desired syllable in the lyric by a manipulation of the touch panel 5, convert the selected syllable into a synthetic singing sound with a desired pitch at a desired timing by an operation of the keyboard 4 and cause it to be outputted.

Figure 11:
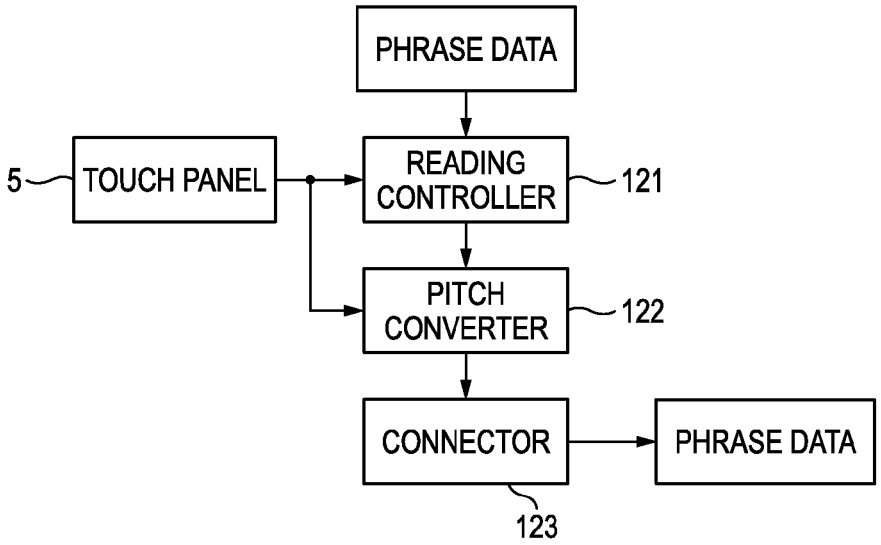
FIG. 11 is a block diagram showing the condition of the synthesizer in a third mode of the real-time playback mode.
Figure 12:
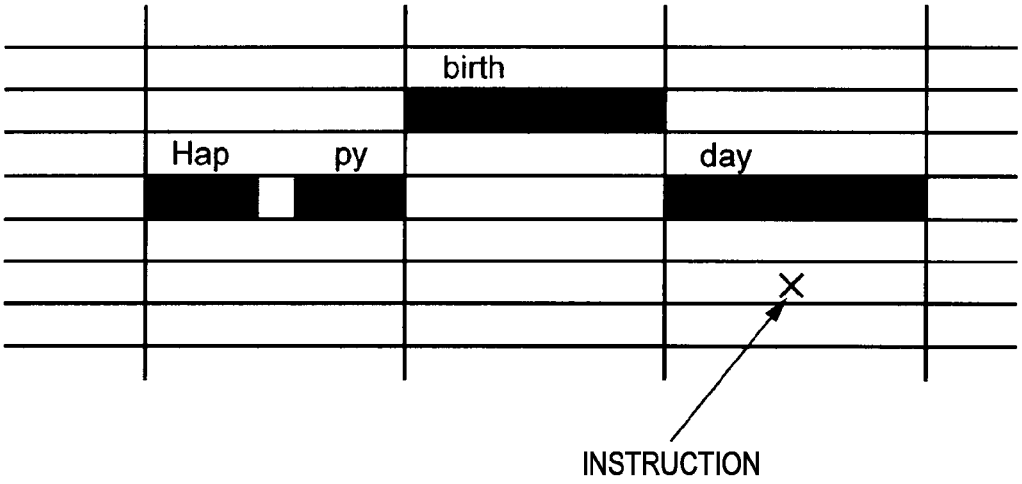
FIG. 12 is a view showing a manipulation example of the synthesizer in the third mode of the real-time playback mode.

FIG. 11 shows the condition of the synthesizer 120 in the third mode. In the third mode, both the reading controller 121 and the pitch converter 122 operate based on a manipulation of the touch panel 5. Further describing in detail, in the third mode, the reading controller 121 reads the syllable pitch data and syllable text data of each syllable of the phrase data stored in the playback object area, and as shown in FIG. 12, displays on the touch panel 5 an image in which the pitches of the syllables are plotted in chronological order on a two-dimensional coordinate system with the horizontal axis as the time axis and the vertical axis as the pitch axis. In this FIG. 12, the black rectangles represent the pitches of the syllables, and the letters such as "Hap" added to the rectangles represent the syllables.

Under this condition, when the user specifies, for example, the rectangle indicating the pitch of the syllable "Hap", the reading controller 121 reads the syllable data corresponding to the syllable "Hap" in the phrase data stored in the playback object area, supplies it to the pitch converter 122, and instructs the pitch converter 122 to perform pitch conversion to the pitch corresponding to the position on the touch panel 5 designated by the user, that is, the original pitch represented by the syllable pitch data of the syllable "Hap" in this example. As a consequence, the pitch converter 122 performs the designated pitch conversion on the syllable waveform data of the syllable data of the syllable "Hap", and supplies the syllable data including the pitch-converted syllable waveform data (in this case, the syllable waveform data the same as the original syllable waveform data) to the connector 123. Thereafter, an operation similar to the above is performed when the user specifies the rectangle indicating the pitch of the syllable "py" and the rectangle indicating the pitch of the syllable "birth".

It is assumed that the user then specifies a position below the rectangle indicating the pitch of the syllable "day" as shown in FIG. 12. In this case, the reading controller 121 reads the syllable data corresponding the syllable "day" from the playback object area, supplies it to the pitch converter 122, and instructs the pitch converter 122 to perform pitch conversion to the pitch corresponding to the position on the touch panel 5 designated by the user, that is, a pitch lower than the pitch represented by the syllable pitch data of the syllable "day" in this example. As a consequence, the pitch converter 122 performs the designated pitch conversion on the syllable waveform data in the syllable data of the syllable "day", and supplies the syllable data including the pitch-converted syllable waveform data (in this case, syllable waveform data the pitch of which is lower than that of the original syllable waveform data) to the connector 123.

As described above, in the third mode, the user can select a desired lyric by a manipulation of the touch panel 5, convert a desired syllable of this selected lyric into a synthetic singing sound with a desired pitch at a desired timing by a manipulation of the touch panel 5 and cause it to be outputted.

As described above, according to the present embodiment, the user can select a desired lyric from among the displayed lyrics by an operation of the operation portion, convert each syllable of the lyric into a synthetic singing sound with a desired pitch and cause it to be outputted. Consequently, a real-time vocal performance rich in extemporaneousness can be easily realized. Moreover, according to the present embodiment, since pieces of phrase data corresponding to various lyrics are prestored and the phrase data corresponding to the lyric selected by the user is used to generate a synthetic singing sound, a shorter time is required to generate a synthetic singing sound.

<Other Embodiments>

While an embodiment of this invention has been described above, other embodiments are considered for this invention, for example, as shown below:

(1) Since the number of lyrics that can be displayed on the touch panel 5 is limited, the phrase data for which the menu of lyrics is displayed on the touch panel 5 may be determined, for example, by displaying the icons indicating the pieces of phrase data constituting the phrase database 140 on the touch panel and letting the user to select a desired ion among these icons.

(2) To facilitate the selection of a lyric, it may be performed to provide priorities to the pieces of phrase data constituting the phrase database 140, for example, based on the genre of the song to be played or the like and display the menu of lyrics of the pieces of phrase data, for example, in order of decreasing priority on the touch panel 5. Alternatively, it may be performed to display the lyrics of pieces of phrase data with higher priorities are displayed closer to the center or in larger letters.

(3) To facilitate the selection of a lyric, lyrics may be hierarchized so that a desired lyric can be selected by designating a hierarchy of each of higher to lower hierarchies. For example, the user selects the genre of a desired lyric and then, selects the first letter (alphabet) of the desired lyric, and the lyric belonging to the selected genre and having the selected first letter is displayed on the touch panel 5. The user selects the desired lyric from among the displayed lyrics. Alternatively, a display method based on relevance may be adopted such as grouping pieces of phrase data with high relevance and displaying the lyrics thereof or displaying lyrics of pieces of phrase data with higher relevance closer. In that case, it may be performed to display, when the user selects one piece of phrase data, the lyrics of pieces of phrase data relevant to the selected pieces of phrase data. For example, in a case where pieces of phrase data of a plurality of lyrics which are each originally a part of one lyric are present, when the phrase data of a lyric is selected by the user, other lyrics belonging to the same lyric may be displayed. Alternatively, the following may be performed: The lyrics of the first, second and third verses of the same song are associated with one another and when one lyric is selected, other lyrics associated therewith are displayed. Alternatively, the following may be performed: A keyword search for the phrase data associated with the user selected lyric is performed on the syllable text data in the phrase database 140 and the lyric of the hit phrase data (syllable text data) is displayed.

(4) The following are considered as a mode for inputting lyric data: First, a camera is provided to the sound synthesis apparatus. Then, the user sings a desired lyric, and the user's mouth at that time is imaged by the camera. The image data obtained by this imaging is analyzed, and the lyric data representative of the lyric that the user is singing is generated based on the movement of the user's mouth shape.

(5) In the edit mode, the pronunciation timing of the syllable of the lyric data and the musical note data may be quantized so as to be the generation timing of a rhythm sound in a preset rhythm pattern. Alternatively, when the lyric is inputted by a softkey operation, the syllable input timing may be the pronunciation timing of the syllable in the lyric data and the musical note data.

(6) While a keyboard is used as the operation portion for pitch designation and pronunciation timing specification in the above-described embodiment, a device other than a keyboard such as a drum pad may be used.

(7) While phrase data is generated from a pair of lyric data and musical note data and stored in the phrase database 140 in the above-described embodiment, phrase data may be generated from a recorded singing sound and stored in the phrase database 140. Further describing in detail, the user sings a desired lyric, and the singing sound is recorded. Then, the waveform data of the recorded singing sound is analyzed to thereby divide the waveform data of the singing sound into pieces of syllable waveform data, each piece of syllable waveform data is analyzed to thereby generate syllable text data representative of the contents of each syllable as a phonogram and syllable pitch data representative of the pitch of each syllable, and these are put together to thereby generate phrase data.

(8) While the sound fragment database 130 and the phrase database 140 are stored in the non-volatile memory 8 in the above-described embodiment, it may be performed to store them on a server and perform singing synthesis by the sound synthesis apparatus's access to the sound fragment database 130 and the phrase database 140 on this server through a network.

(9) While the phrase data obtained by the processing by the synthesizer 120 is outputted as a synthetic singing sound from the sound system 7 in the above-described embodiment, the generated phrase data may be merely stored in a memory. Alternatively, the generated phrase data may be transferred to a distant place through a network.

(10) While the phrase data obtained by the processing by the synthesizer 120 is outputted as a synthetic singing sound from the sound system 7 in the above-described embodiment, the phrase data may be outputted after undergoing effect processing specified by the user.

(11) In the real-time playback mode, a special singing synthesis may be performed in accordance with a change of the specified position on the touch panel 5. For example, in the second mode of the real-time playback mode, the following may be performed: When the user moves a finger along one syllable displayed in the direction area from the end toward the beginning, the syllable waveform data corresponding to the syllable is reversed and supplied to the pitch converter 122. Alternatively, in the first mode of the real-time playback mode, the following may be performed: When the user moves a finger along a lyric displayed in the direction area from the end toward the beginning and then, performs a keyboard performance, syllables are successively selected from the syllable at the end and a singing synthesis corresponding to each syllable is performed every key depression. Alternatively, in the first mode of the real-time playback mode, the following may be performed: When the user specifies the beginning of a lyric displayed in the direction area to select the lyric and then, performs a keyboard performance, syllables are successively selected from the syllable at the beginning, and a singing synthesis corresponding to each syllable is performed. When the user specifies the end of a lyric displayed in the direction area to select the lyric and then, performs a keyboard performance, syllables are successively selected from the syllable at the end and a singing synthesis corresponding to each syllable is performed every key depression.

(12) In the above-described embodiment, the user selects the phrase data representative of a singing sound (singing voice), and this phrase data is processed according to a keyboard operation or the like and outputted. However, the following may be performed: As the phrase data, the user selects the phrase data representative of the sound waveform other than that of a singing sound and the phrase data is processed according to a keyboard operation or the like and outputted. Moreover, the following may be performed: A pictogram such as one used in e-mails sent from mobile phones is included in the phrase data, and a lyric including this pictogram is displayed on the touch panel and used for phrase data selection.

(13) In the real-time playback mode, when the lyric selected by the user is displayed in the direction area of the touch panel, for example as shown in FIG. 8, symbols representative of syllable separation ("/" in FIG. 8) may be added to the display of the lyric. Doing this facilitates the user's visual recognition of syllables. Moreover, the following may be performed: The display form of the singing synthesis part is made different from that of other parts, such as making different the display color of the syllable on which singing synthesis is being currently performed, so that the singing synthesis part is apparent.

(14) The syllable data constituting the phrase data may be only the syllable text data. In this case, in the real-time playback mode, when a syllable is designated as the object to be played back and the pitch is designated with a keyboard or the like, the syllable text data corresponding to the syllable is converted into sound waveform data having the pitch designated with the keyboard or the like and outputted from the sound system 7.

(15) When a predetermined command is inputted by a manipulation of the touch panel 5 or the like, the first mode of the real-time playback mode may be switched as follows: First, in a case where a syllable in the lyric displayed in the direction area of the touch panel 5 is designated when a key depression of the keyboard 4 occurs, switching from the first mode to the second mode is made, and the designated syllable is outputted as a synthetic singing sound of the pitch designated by the key depression. Moreover, in a case where the direction area of the touch panel 5 is not designated when a key depression of the keyboard 4 occurs, the first mode is maintained, and the syllable next to the syllable on which singing synthesis was performed last time is outputted as a synthetic singing sound of the pitch designated by the key depression. In this case, for example, when a lyric "Happy birthday to you" is displayed in the direction area, if the user designates the syllable "birth" and depresses a key, the second mode is set, and the syllable "birth" is pronounced with the pitch of the depressed key. Thereafter, if the user depresses a key without designating the edit area, the first mode is set, and the syllable "day" next to the syllable on which singing synthesis was performed last time is pronounced with the pitch of the depressed key. According to this mode, the degree of freedom of vocal performance can be further increased.

The present application is based on Japanese Patent Application No. 2012-144811 filed on Jun. 27, 2012, the contents of which are incorporated herein by reference.

What is claimed is:

1. A sound synthesis method using an apparatus connected to a display device, the sound synthesis method comprising:

a first step of displaying a plurality of lyrics on a screen of the display device;

a second step of selecting a lyric among the plurality of the lyrics displayed on the screen in response to an operation of a selecting member after the first step is completed, the lyric including a plurality of sections;

a third step of inputting a pitch based on an operation of a user;

a fourth step of selecting one section among the plurality of sections of the lyric in response to an operation of the selecting member;

a fifth step of converting the selected section into a piece of a synthetic singing sound data with the inputted pitch; and a sixth step of generating a whole of the synthetic singing sound data representing the displayed lyric by conducting the fifth step with respect to another section of the lyric in an arrangement order of the plurality of sections of the lyric every time the pitch is inputted.

2. The sound synthesis method according to claim 1, further comprising:

a seventh step of storing a piece of phrase data representing a sound corresponding to the lyrics displayed on the screen into a storage in the apparatus, and the piece of phrase data being constituted by a plurality of pieces of syllable data, wherein in the fifth step, pitch conversion based on the inputted pitch is performed on each of the plurality of pieces of syllable data, which constitutes the piece of phrase data to generate and output the piece of waveform data representing the singing sound with the pitch.

3. The sound synthesis method according to claim 2, wherein every time the pitch is inputted in the third step, a sequence of syllable data is read among the plurality of pieces of syllable data stored in the storage and the pitch conversion based on the inputted pitch is performed on the sequence of syllable data.

4. The sound synthesis method according to claim 2, wherein the lyrics displayed on the screen in the first step is constituted by a plurality of syllables, the sound synthesis method further comprising:

an eighth step of selecting a syllable among the lyrics displayed on the screen, wherein when the pitch based on the operation of the user is inputted in the third step after the first step and the eighth step are completed, a piece of syllable data corresponding to the syllable selected in the eighth step is read from the storage and the pitch conversion based on the inputted pitch is performed on the read piece of the syllable data.

5. The sound synthesis method according to claim 1, wherein the plurality of lyrics is displayed on the screen based on a result of a keyword search.

6. The sound synthesis method according to claim 1, wherein the lyrics displayed on the screen in the first step is constituted by a plurality of syllables; and wherein syllable separations, which separate the plurality of syllables respectively, are visually displayed on the screen.

7. The sound synthesis method according to claim 1, wherein the plurality of lyrics are hierarchized in a hierarchical structure having hierarchies; and wherein the lyric, which is selected by designating at least one hierarchy among the hierarchies, is displayed on the screen in the first step.

8. The sound synthesis method according to claim 1, wherein the one section of the lyric is a syllable.

9. A sound synthesis apparatus connected to a display device, the sound synthesis apparatus comprising:

a processor configured to:

display a plurality of lyrics on a screen of the display device;

select a lyric among the plurality of lyrics displayed on the screen in response to an operation of a selecting member after the lyric has been displayed on the screen, the lyric including a plurality of sections;

inputting a pitch based on an operation of a user;

selecting one section among the plurality of sections of the lyric in response to an operation of the selecting member;

converting the selected section into a piece of synthetic singing sound data with the inputted pitch; and generating a whole of synthetic singing sound data representing the displayed lyric by converting another section of the lyric into another piece of synthetic singing sound data with the inputted pitch in an arrangement order of the plurality of sections of the lyric every time the pitch is inputted.

10. The sound synthesis apparatus according to claim 9, further comprising:

a storage, wherein the processor stores a piece of phrase data representing a sound corresponding to the lyric displayed on the screen into the storage;

wherein the piece of phrase data is constituted by a plurality of pieces of syllable data; and wherein the processor performs pitch conversion based on the inputted pitch on each of the plurality of pieces of syllable data, which constitutes the piece of phrase data to generate and output the piece of waveform data representing the singing sound with the pitch.

11. The sound synthesis apparatus according to claim 10, wherein every time the processor inputs the pitch, a sequence of syllable data is read among the plurality of pieces of syllable data stored in the storage and the pitch conversion based on the inputted pitch is performed on the sequence of syllable data.

12. The sound synthesis apparatus according to claim 9, wherein the operation of the user is conducted through a keyboard or a touch panel provided on the screen of the display device.

13. The sound synthesis apparatus according to claim 9, wherein the one section of the lyric is a syllable.

* * * * *